United States Patent [19]

Kuo

[11] 4,257,049

[45] Mar. 17, 1981

[54] PERIODICALLY LOADED ANTENNA STRUCTURE

[75] Inventor: Samuel C. Kuo, Saratoga, Calif.

[73] Assignee: GTE Products Corporation, Stamford, Conn.

[21] Appl. No.: 84,843

[22] Filed: Oct. 15, 1979

[51] Int. Cl.[3] ..... H01Q 11/10

[52] U.S. Cl. ..... 343/792.5

[58] Field of Search ..... 343/792.5, 908

[56] References Cited

U.S. PATENT DOCUMENTS

| | | | |
|---|---|---|---|
| 3,212,094 | 10/1965 | Berry | 343/792.5 |
| 3,271,775 | 9/1966 | Yang | 343/792.5 |
| 3,594,807 | 7/1971 | Tanner | 343/792.5 |
| 3,696,438 | 10/1972 | Ingerson | 343/792.5 |
| 3,808,599 | 4/1974 | Brunner | 343/792.5 |
| 4,152,706 | 5/1979 | Barbano et al. | 343/792.5 |

*Primary Examiner*—Eli Lieberman

*Attorney, Agent, or Firm*—John F. Lawler

[57] ABSTRACT

A log-periodically loaded monopole antenna comprises a plurality of longitudinally log-periodically spaced longitudinally tapering linear radiating elements in a vertical plane, a meander transmission line (meanderline) in a second plane perpendicular to the vertical plane and extending longitudinally on opposite sides of the plane of the elements and intersecting successive elements at the cross-over points, and a straight transmission line or shunt in the second plane interconnecting the junctions of the elements and the meanderline. The addition of this shunt substantially eliminates the large gain drop-out characteristic of this antenna, the voltage standing wave ratio being reduced from an average of 6:1 to less than 1.6:1. In one embodiment the elements are pivotally connected to the transmission line for pivoting in the vertical plane to permit collapsing of the elements toward the plane of the transmission line when required due to space limitations.

3 Claims, 10 Drawing Figures

PERIODICALLY LOADED ANTENNA STRUCTURE

BACKGROUND OF THE INVENTION

This invention relates to frequency independent antennas and more particularly to an improved log-periodic monopole antenna.

Logarithmically periodic (log-periodic) antennas theoretically have an unlimited bandwith. In practice, the low and high cutoff frequencies of the log-periodic antenna are limited by the physical size of the largest radiating element and the structure at the feed point, respectively. One type of log-periodic antenna is a balanced two-wire transmission line loaded with dimensionally tapered dipole radiating elements at log-periodic spacings, one-half of each dipole being connected to a different wire of the line. The difficulty with this antenna is that the close spacing of the dipole elements produces a reduction in phase velocity so that the antenna does not provide true frequency independent performance. When the feed lines are transposed from element to element of successive dipoles, an additional radiation phase delay is introduced between adjacent dipole pairs producing the well-known, versatile log-periodic dipole antenna described in the article entitled "Log-Periodic Dipole Arrays" by D. E. Isbell, Trans IRE, Vol. AP-8, No. 3, May 1960, pp. 260–267. The transposition of the feedline, however, spoils the symmetry of the structure and hence makes it impossible to employ half of the dipole array over a ground plane to form a log-periodic monopole antenna in the conventional manner.

One proposed solution to the latter problem is a log-periodic monopole antenna employing a meander transmission line (meanderline). this antenna is described in a paper entitled "Directive Frequency Independent Arrays" by K. K. Mei et al, IEEE Transactions on Antennas and Propagation (communications), Vol. AP-13, September 1965, pp. 807–809. The purpose of the meanderline is to introduce additional phase delay between adjacent radiating elements comparable to the transposition of the feed line of the conventional log-periodic dipole antenna while at the same time maintaining a symmetrical structure. The Mei et al antenna consists of log-periodically scaled linear radiating elements, such as rods or strips, connected by a tapered meanderline, the radiating element portion of the antenna structure being similar to one-half of the log-periodic dipole antenna and the meanderline providing the phase delay essential for backfire radiation for the resonant elements. The difficulty with this antenna is that it exhibits periodic gain drop-out or dip characteristics which negate frequency independent impedance performance. This problem and a proposed solution to it are discussed in an article entitled "Log-Periodic Antennas with Modulated Impedance Feeders" by P. G. Ingerson et al, IEEE Trans. On Antennas and Propagation, Vol. AP-16, November 1968, pp. 633–642. Ingerson et al proposed a modulated impedance feeder for the antenna which, however, may exhibit additional gain drop-out regions in antenna performance over the operating band thereby seriously impairing the usefulness of the antenna. In addition, the Ingerson et al antenna structure is somewhat complex with attendant increase in cost to construct, and is almost impossible to build for frequencies higher than 12 GHz.

Although the height of a vertically polarized monopole antenna is approximately one-half that of the dipole counterpart, that height can be substantial for operating frequencies in the HF band (3–30 MHz). For example, the height of the radiating element above the ground plane at 20 MHz is 4 meters. This imposes a space requirement for such an antenna that restricts its usefulness in applications where available space is limited. The problem is accentuated when such antenna is mounted on a mobile platform.

This invention is directed to an improved log-periodic monopole which overcomes the above problems.

OBJECTS AND SUMMARY OF THE INVENTION

A general object of this invention is the provision of a broadband log-periodic monopole antenna with linear radiating elements and having a maximum VSWR of 1.6:1 across its operating band.

A further object is the provision of a log-periodic monopole antenna with a meanderline feed and having a substantially constant gain characteristic over the operating band.

Still another object is the provision of such an antenna with means for mechanically connecting the radiating elements to the feed line to permit substantial reduction of the antenna height quickly and without disassembling the antenna.

These and other objects of the invention are achieved with a modification to a log-periodic monopole antenna having a plurality of linear radiating elements connected to a meanderline at longitudinally spaced points, the modification consisting of a straight conductor or shunt connected between the connections of the elements to the meanderline. This shunt greatly reduces gain fluctuations across the operating band so as to make this the first operationally practicable log-periodic monopole antenna. The radiating elements are connectable to the meanderline to permit some or all of the elements to pivot quickly between an upright operational position and a collapsed or partially collapsed inoperative position closer to the plane of the meanderline.

DESCRIPTION OF PREFERRED EMBODIMENTS

Figure 1:
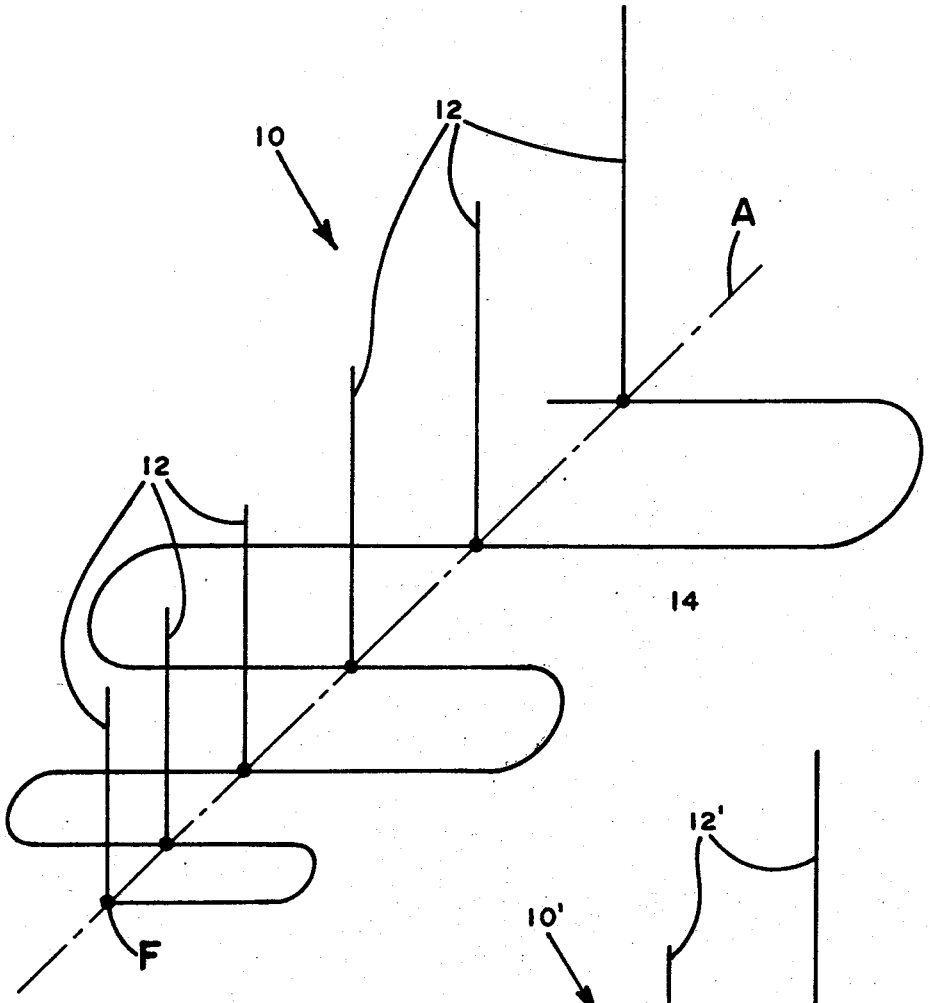
FIG. 1 PRIOR ART
FIG. 1 is a schematic representation of a log-periodic monopole antenna described in the prior art.

Referring now to the drawings, FIG. 1 depicts a log-periodic monopole antenna 10 of the type described in the above-identified publication by Mei et al comprising a plurality of wire-like radiating elements 12 aligned in the vertical plane and connected to a meander transmission line (meanderline) 14 disposed substantially in a horizontal plane. The lengths and longitudinal spacings of elements 12 decrease in progressive increments of a predetermined ratio in a direction toward the feed point F of the antenna as is well known in the art. Similarly, the lengths of meanderline 14 between adjacent elements are substantially greater than the corresponding interelement longitudinal spacings and these line lengths decrease toward the feed point in progressive increments of that ratio. The antenna 10 is mounted over a ground plane, not shown, proximate to meanderline 14 and produces and end fire radiation pattern along the antenna axis A in the direction toward the antenna feed. point, i.e., to the left as viewed in the drawing.

The difficulty with the antenna of FIG. 1 is the periodic reductions or drops in gain which it exhibits over its operating frequency band. Such gain fluctuations typically are 4–5 db. The reason for such performance is not understood but nevertheless it has seriously impaired the utility of such log-periodic monopole antennas. In accordance with this invention, the periodic reduction or drop in gain is greatly reduced or substantially eliminated in a substantially identical antenna 10' shown in FIG. 2 by shunting the connections of its elements 12' to meanderline 14' by straight conductive lines or shunts 16. The effect of this simple structural change is to render the log-periodic monopole antenna practicable for operation across an octave bandwidth or greater. The reason for this improved performance is not fully understood. It is believed, however, that when the physical length of a certain section of the meanderline is a fraction of wavelength, for example, a quarter wavelength at the operating frequency, it will have a very high impedance. When this section of meanderline is located between the feed and the radiation region on the antenna structure, the input impedance of this antenna will have a high value and consequently will introduce a gain drop at this particular operating frequency. Since the physical length of each meanderline is scaled by $\tau$, the frequencies at which the gain dropouts occur are also scaled by the same factor $\tau$. When the straight transmission line or shunt is added to the meanderline, the currents flow through the shunts and not through the meanderline to reach the radiation region so as to eliminate the periodical gain dropouts. In the radiation region, it is believed that the currents flow through the meanderline and not through the shunts and therefore provide the backfire radiation condition required for successful log-periodic antennas.

Figure 2:
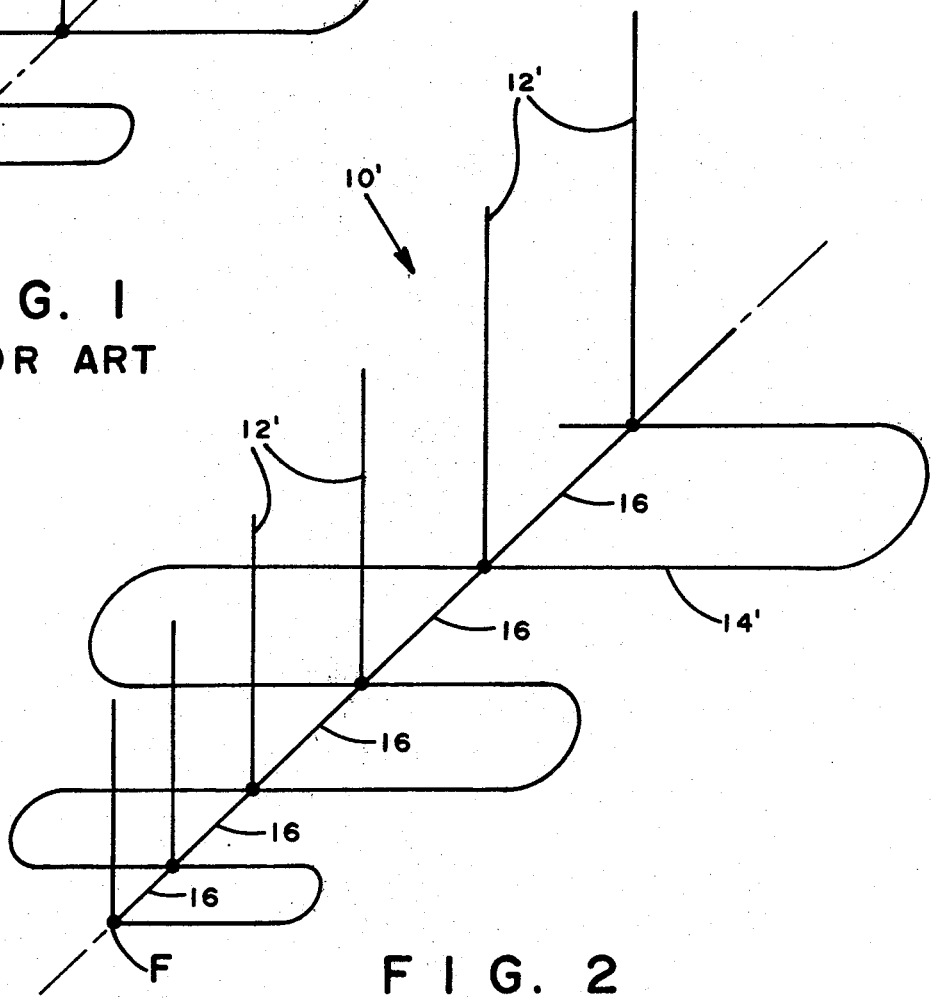
FIG. 2 is a view similar to FIG. 1 of an antenna modified in accordance with this invention.
Figure 3:
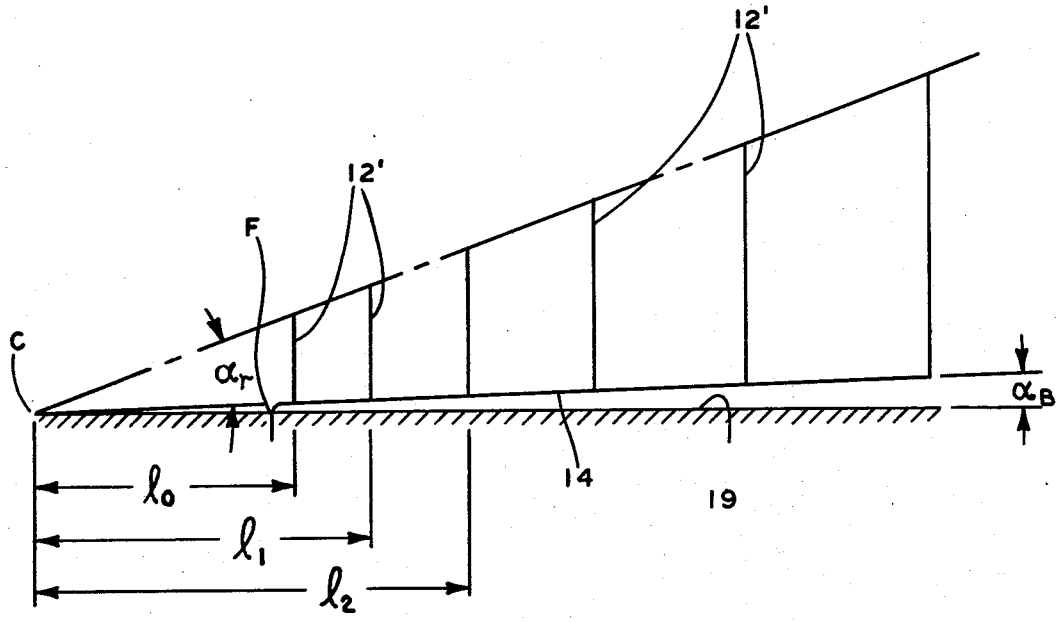
FIG. 3 is a side elevation of the antenna of FIG. 2.
Figure 4:
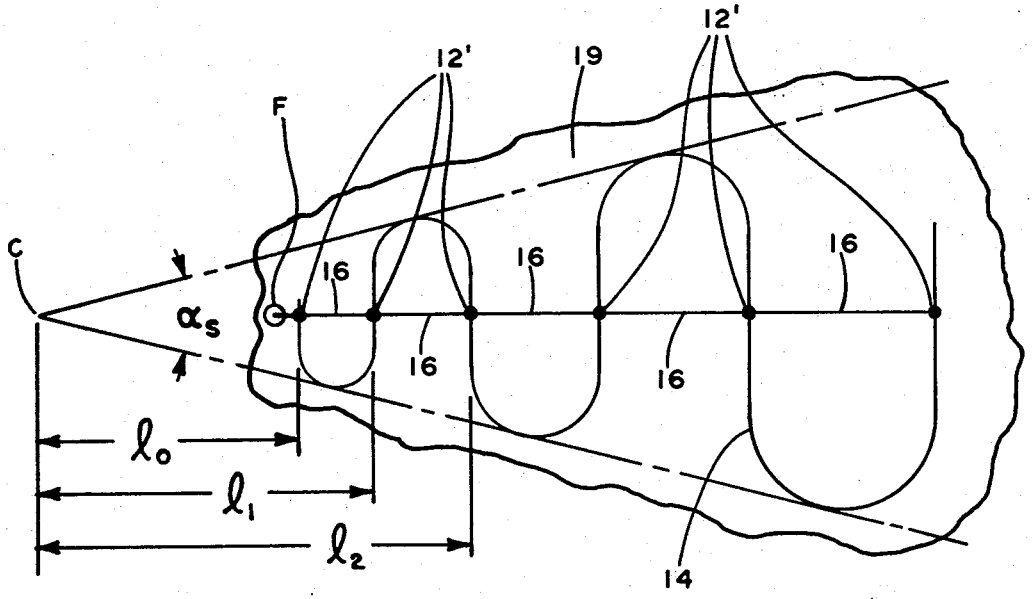
FIG. 4 is a top plan view of the antenna of FIG. 2.

FIGS. 3 and 4 show elevation and plan views, respectively, of the antenna of FIG. 2 and depict the feed point 18 at the left as viewed, the ground plane 19, the angles of divergence $\alpha_r$ and $\alpha_B$ of the elements 12 and transmission line 14, respectively, with respect to the ground plane and the lengths $l_0$, $l_1$, and $l_2$of the initial elements from the point C of convergence of the antenna elements. As is well known in the art, the interelement spacing as well as the lengths of elements 12 decrease in the direction toward feed point 18 in progressive increments of a predetermined ratio $\tau$ which is defined as $$l_1 l_{n+1} = \tau$$

Figure 5:
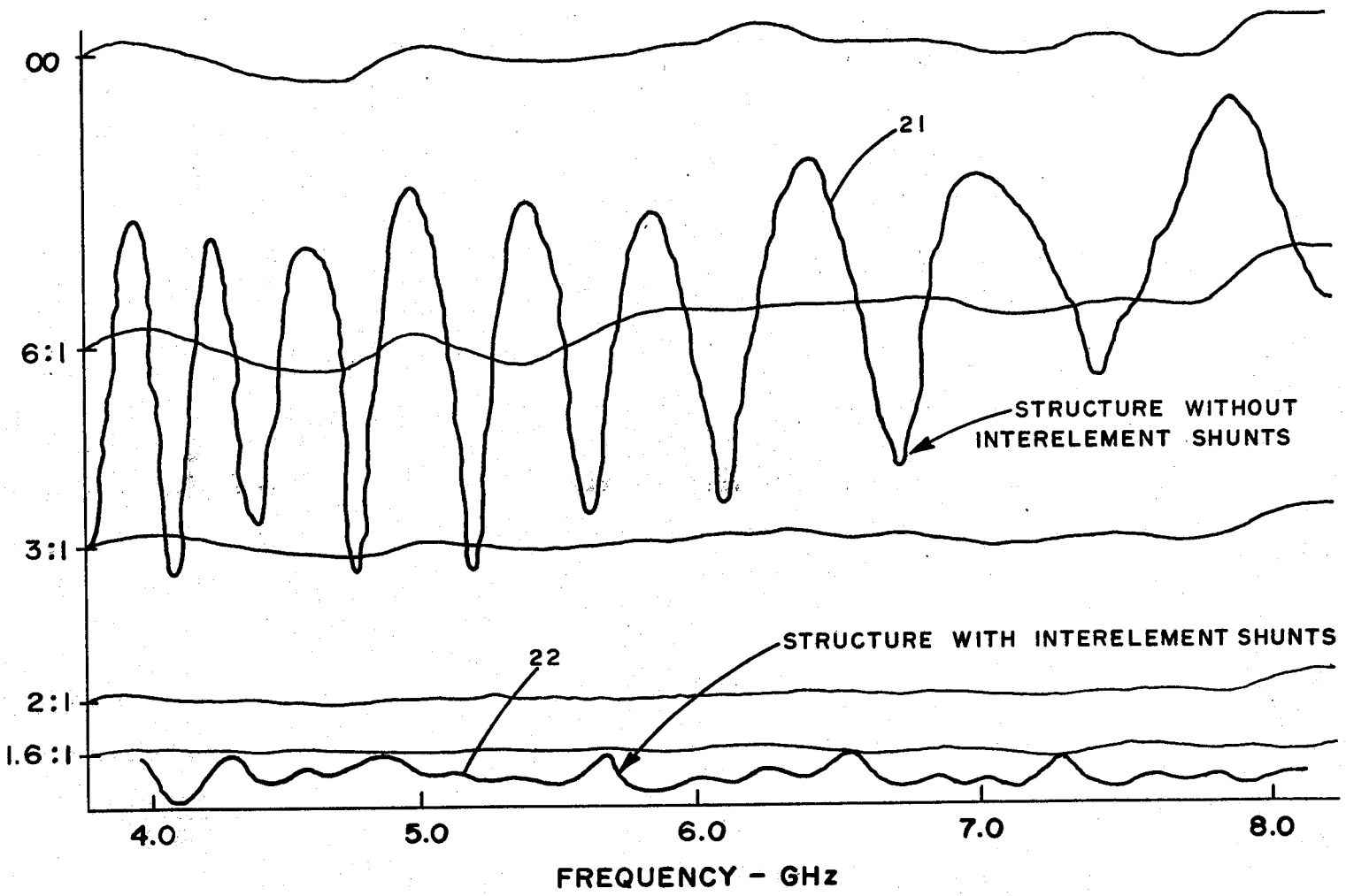
FIG. 5 is a plot showing comparative performance characteristics of the antennas of FIGS. 1 and 2.

FIG. 5 shows a performance curve 21 for a meanderline fed monopole antenna of the type shown in FIG. 1 and a similar curve 22 for an identical antenna modified in accordance with this invention with the interelement shunts 16. It will be noted that curve 21 has large periodic fluctuations between limits greater than and less than a voltage standing wave ratio (VSWR) of 6:1 whereas curve 22 has greatly reduced periodic variations with a maximum VSWR of 1.6:1 over the band of 4.0 to 8.0 GHz.

The design parameters of the monopole antenna on which tests were run to produce the performance curves shown in FIG. 5 are as follows:

Number of elements 17
Length of longest monopole 4.36 inches
Length of shortest monopole 0.82 inches
Angle of divergence $\alpha_r \cdot °$
Angle of divergence $\alpha_s$ 18°
Log-periodic constant $\tau$ 0.916

Figure 6:
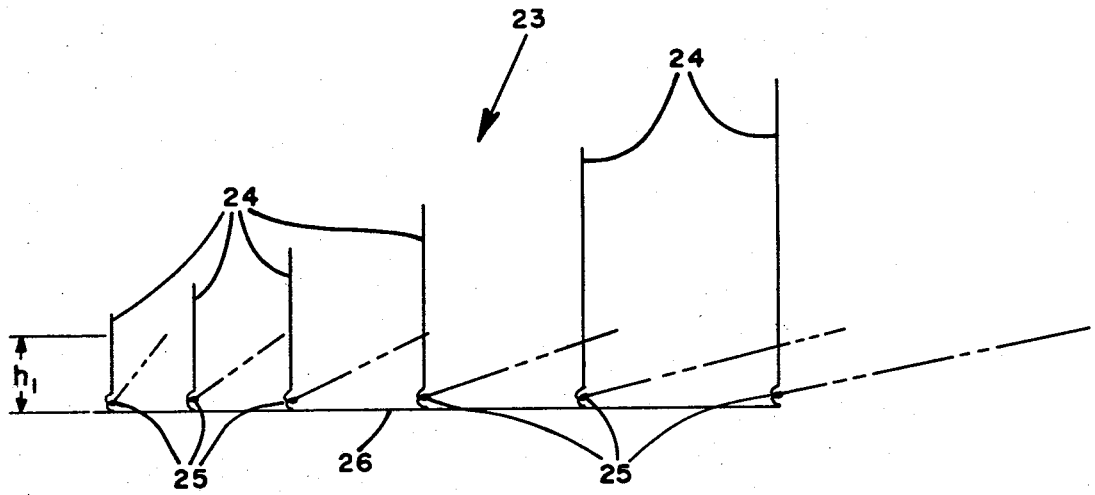
FIG. 6 is a schematic side elevation of an antenna embodying this invention modified to permit pivoting of the monopoles.
Figure 7:
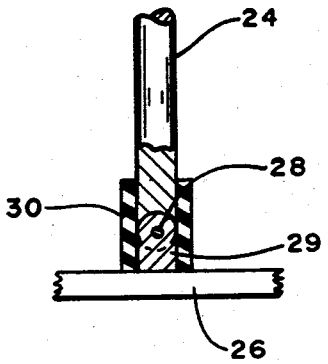
FIGS. 7 and 8 are fragmentary views partially in section of a monopole showing details of the pivotal connection to the feed line.
Figure 8:
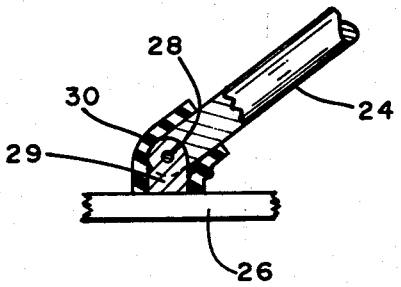

A modified form of the invention is shown in FIGS. 6, 7 and 8 in which a monopole antenna 23 similar to the antenna of FIG. 2 has radiating elements 24 each pivotally connected at 25 to the meander transmission line 26. Pivotal connections 25 permit elements 24 to be folded backwardly in the vertical plane toward the plane of the transmission line as indicated in broken lines when required by space limitations, for example, a height $h_1$ less than the height of the smallest element of the antenna. The elements preferably are resiliently biased into the upright operative position when such reduction in height is not required.

FIGS. 7 and 8 show details of construction of a pivot 25 in which the lower end of element 24 is connected by pin 28 to a pivot base 29 secured to transmission line 26, the adjacent parts of element 24 and base 29 being enclosed in a rubber-like sleeve 30 for biasing the element into a position substantially perpendicular to the transmission line as shown in FIG. 7. Sleeve 30 is sufficiently resilient to permit the element to rotate about the axis of pin 28 as shown in FIG. 8 when a reduction in height of the antenna is desired and in response to a force applied against the element.

Figure 9:
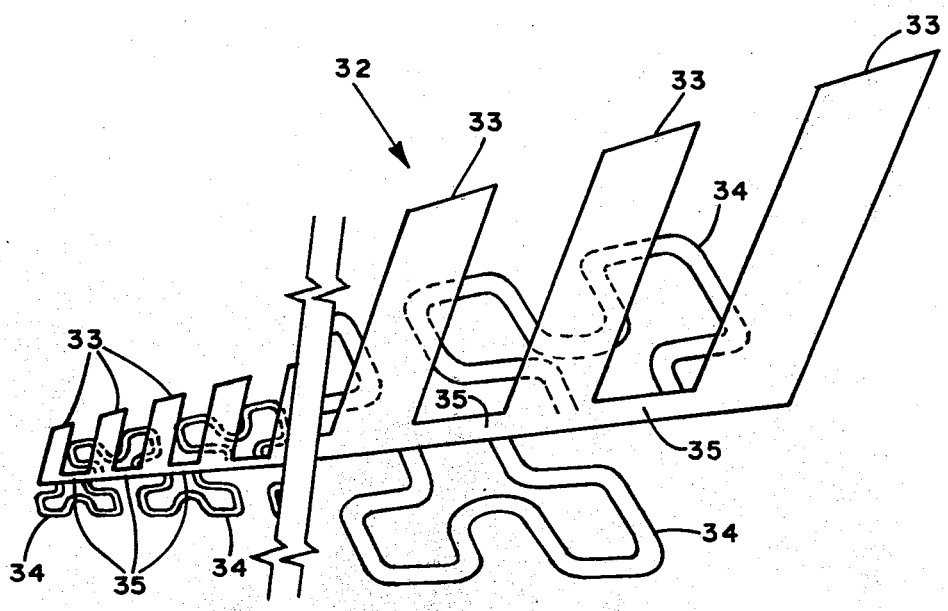
FIGS. 9 and 10 are modified forms of the invention showing different sizes and shapes of radiating elements and meanderlines.

FIG. 9 shows an antenna 32 embodying a modified form of the invention in which radiating elements 33 comprise solid conductive blades having substantial width in the longitudinal direction. The meanderline 34 is configured as a plurality of rectangular indented loops on opposite sides of the plane of the antenna and offset by a distance equal to the width of the corresponding elements. Shunts 35 interconnect adjacent elements according to this invention.

Figure 10:
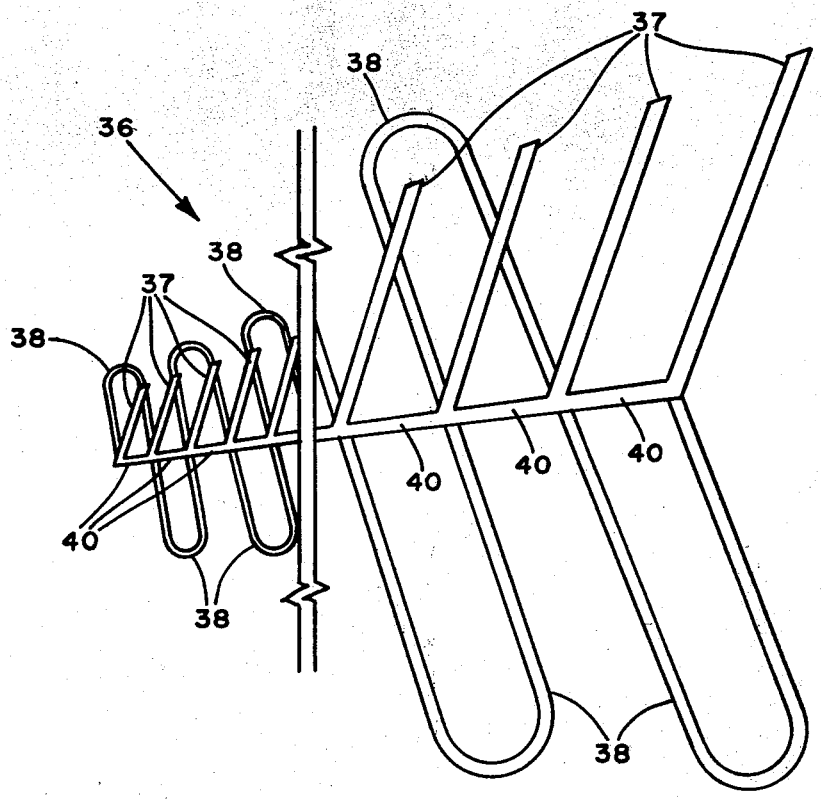

The antenna 36 shown in FIG. 10 embodies another modified form of the invention in which the radiating elements 37 comprise relatively narrow conductive strips and the meanderline 38 is configured in a plurality of U-shaped loops on opposite sides of the antenna plane. In accordance with the invention, shunt connectors 40 interconnect adjacent elements 37 of the array.

What is claimed is:

1. A log-periodic monopole antenna adapted for use over a ground plane comprising a plurality of longitudinally spaced linear parallel radiating elements disposed in a vertical plane and each comprising a single solid rod-like conductor, said elements having dimensions and interelement spacings which increase in one longitudinal direction in progressive increments of a predetermined ratio, a meander transmission line disposed in a plane perpendicular to said vertical plane and connected successively to said elements proximate to said ground plane, the lengths of said line between adjacent elements being substantially greater than corresponding interelement longitudinal spacings, said line lengths increasing in said one direction in progressive increments of a predetermined ratio, and a straight conductive line interconnecting the connections of said elements and said transmission line.

2. A log-periodic monopole antenna adapted for use over a ground plane comprising a plurality of longitudinally spaced linear parallel radiating elements disposed in a vertical plane and each comprising a single solid rod-like conductor, said elements having dimensions and interelement spacings which increase in one longitudinal direction in progressive increments of a predetermined ratio, a meander transmission line disposed in a plane perpendicular to said vertical plane and connected successively to said elements proximate to said ground plane, the lengths of said line between adjacent elements being substantially greater than corresponding interelement longitudinal spacings, said line lengths increasing in said one direction in progressive increments of a predetermined ratio, at least one of said elements being pivotally connected to said line for pivoting in said vertical plane, and a straight conductive line interconnecting the connections of said elements and said transmission lines.

3. The antenna according to claim 2 with means for resiliently biasing said pivoted element in an operative position normal to said ground plane.

* * * * *